US005455566A

United States Patent [19]

Conway

[11] Patent Number: 5,455,566

[45] Date of Patent: Oct. 3, 1995

[54] MODULAR PERSONAL SECURITY SYSTEM

[76] Inventor: Brian Conway, #61, 9633-180 Street, Edmonton, Alberta, Canada, T5T 4G4

[21] Appl. No.: 264,522

[22] Filed: Jun. 23, 1994

[51] Int. Cl.[6] ..... G08B 23/00

[52] U.S. Cl. ..... 340/693; 340/573; 340/692; 340/321

[58] Field of Search ..... 340/693, 321, 340/574, 573, 692, 521; 200/61.93, 61.86; 116/2, 7, 137 R, 214

[56] References Cited

U.S. PATENT DOCUMENTS

| | | | |
|---|---|---|---|
| 2,331,117 | 10/1943 | Goddhue et al. | 222/399 |
| 3,716,170 | 2/1973 | Mangels | 222/162 |
| 3,794,791 | 2/1974 | Thomson | 340/321 |
| 4,241,332 | 12/1980 | Fargue | 340/326 |
| 4,449,474 | 5/1984 | Mariol | 116/2 |
| 4,716,402 | 12/1987 | Francis | 340/693 |
| 4,810,996 | 3/1989 | Glen et al. | 340/692 |
| 4,843,336 | 6/1989 | Kuo | 340/573 |
| 4,964,636 | 10/1990 | Ashihara | 273/84 R |
| 5,177,467 | 1/1993 | Chung-Piao | 340/693 |
| 5,289,164 | 2/1994 | Novak | 340/693 |

OTHER PUBLICATIONS

Article published in S.W.A.T. Magazine Issue of Jan. 1991 Re: Sirens and Alarms, Strobe Light.

Articles published in Women's Self Defense Magazine Issue of Jun. 1994 pp. 79 and 73 Re: DyeWitness Defense Spray, Ear Piercing alarm, high-intensity strobe light and Hidden Edge with full strength pepper spray and a 130dB siren.

P. 138 from U.S. Cavalry Catalog of 1994—ScreamBeam.

P. 15 from Executive Protection Products, Inc. Catalog of 1991—Stunlight.

P. 22 from Sargent-Sowell, Inc. Catalog of 1990-91—High and low beam light.

P. 17 from Information Unlimited Catalog of 1993—Invisible Pain Field Blaster.

Page from Grayhill Catalog of 1990—Spring Return Rotary Switches.

*Primary Examiner*—John K. Peng
*Assistant Examiner*—Benjamin C. Lee
*Attorney, Agent, or Firm*—Anthony R. Lambert

[57] ABSTRACT

A modular personal security device is described which includes a body having an interior battery receiving cavity, a handgrip and at least one module mounting surface whereby electronic and mechanical modules are mounted to the body. A first power supply circuit connects the battery receiving cavity with a first power switch connector on the body and a first power connector on the module mounting surface. A second power supply circuit connects the battery receiving cavity with a second power switch connector on the body and a second power connector on the module mounting surface. A multi-position trigger activated switch module is connected to the first power switch connector and the second power switch connector. Upon the trigger being pressed to one position the first power switch connector completes the first power supply circuit. By continuing to press the trigger to another position the second power switch connector completes the second power supply circuit. Upon the trigger further being pressed to subsequent positions both the first power supply and the second power supply circuits are completed thereby simultaneously supplying power to a modular unit mated with the first power connector and a modular unit mated with the second power connector. The device, as described, is particularly suited for coordinated sequential or simultaneous use of modular units providing multiple personal security features.

12 Claims, 9 Drawing Sheets

MODULAR PERSONAL SECURITY SYSTEM

The present invention relates to a modular personal security system.

BACKGROUND OF THE INVENTION

There are a wide variety of devices on the market which are used for personal security. A partial list includes, a strobe light flash, a chemical spray, an alarm, and a high voltage stun device. The number of possible devices expands every year as new technologies develop.

The needs of the individuals who use personal security devices vary tremendously. A police officer may need a potent, but nonlethal, alternative to a handgun. A teen or senior citizen may need a device which will provide defense to an attack on their person. A security guard may need a combination of these security features. When personal preferences are also factored in, it is apparent that there is no one security device suitable for all needs.

The concept of a modular personal security device is known; having been disclosed in U.S. Pat. No. 4,716,402 granted to Francis in 1987. The Francis reference is primarily a room security device that is capable of playing a secondary personal security role. The problem with the Francis reference is that the components have minimal coordination and, as such, the device is more of an aggregation of features than a coordinated personal security device.

SUMMARY OF THE INVENTION

What is required is a modular personal security system with an option to activate a plurality of coordinated defensive modules in a sequence, or simultaneously.

According to the present invention there is provided a modular personal security device which includes a body having an interior battery receiving cavity, a handgrip and at least one module mounting surface whereby electronic and mechanical modules are mounted to the body. A first power supply circuit connects the battery receiving cavity with a first power switch connector on the body and a first power connector on the module mounting surface. A second power supply circuit connects the battery receiving cavity with a second switch connector on the body and a second power connector on the module mounting surface. The first power supply circuit and the second power supply circuit have at least one ground line extending from the battery receiving cavity to a first ground connector and a second ground connector on the module mounting surface. A multi-position trigger activated switch module is connected to the first power switch connector and the second power switch connector. Upon the trigger being manually pressed to one position the first power switch connector completes the first power supply circuit thereby supplying power to a modular unit mated with the first power connector. Upon the trigger being further pressed to another position the second power switch connector completes the second power supply circuit thereby supplying power to a modular unit mated with the second power connector. Upon the trigger being further pressed to subsequent positions the first power switch connector completes the first power supply circuit and the second power switch connector completes the second power supply circuit thereby simultaneously supplying power to a modular unit mated with the first power connector and a modular unit mated with the second power connector.

With the personal security device, as described, the multi-position trigger switch activates modules when the trigger is pressed.

Although beneficial results may be obtained through the use of a personal security device, as described above, the use of disabling sprays is very common in personal security devices. There is a need to coordinate the use of disabling sprays with electronic and mechanical components. Even more beneficial results may, therefore, be obtained when the body has a spray tank mount and a liquid conduit extending through the body. The liquid conduit must have a connector end positioned adjacent the spray tank mount and a nozzle end. The spray tank used has male adaptor insertable into the connector end of the liquid conduit. The spray tank has an actuating valve which is on a common plane with the trigger, such that the trigger engages the actuating valve as the trigger is depressed. When the personal security device has provision for the addition of the spray tank module, as described above, by continuing to press the trigger the actuating valve on the spray tank module is depressed to release the disabling spray at end of trigger travel. This feature allows for a complete systematic activation for modular units connected to the first power supply circuit, modular units connected to the second power supply circuit and modular spray systems. The activation can be made sequentially or simultaneously depending upon trigger positioning and the speed of trigger movement.

Although beneficial results may be obtained through the use of the personal security device, as described above, it would be disastrous if the electronic and mechanical modules became detached from the body during an attack by an assailant. Even more beneficial results may, therefore, be obtained when means is provided for locking the electronic and mechanical modules to the body. The preferred means includes modules having mating members in the form of rotatably mounted depending key-like fasteners that axially align with key hole receptacles located on the body of the device or other modules designed for stacking. The key-like fasteners are inserted into the key hole and partially rotated to lock members in a mated position.

Most airports have strict regulations regarding taking pressurized containers onto aircraft. There are also strict regulations as to what spray medium is legal in various jurisdictions. Even more beneficial results may, therefore, be obtained when the spray tank module has a standard air valve whereby the contents of the spray tank may be replenished with a spray medium which is legal for the jurisdiction and then pressurized with an air pump. This enables the pressure to be released from the tank prior to boarding an aircraft, and upon landing the tank can be recharged at any service station or wherever there is access to an air compressor. It also enables the spray medium drained, if that is desired.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
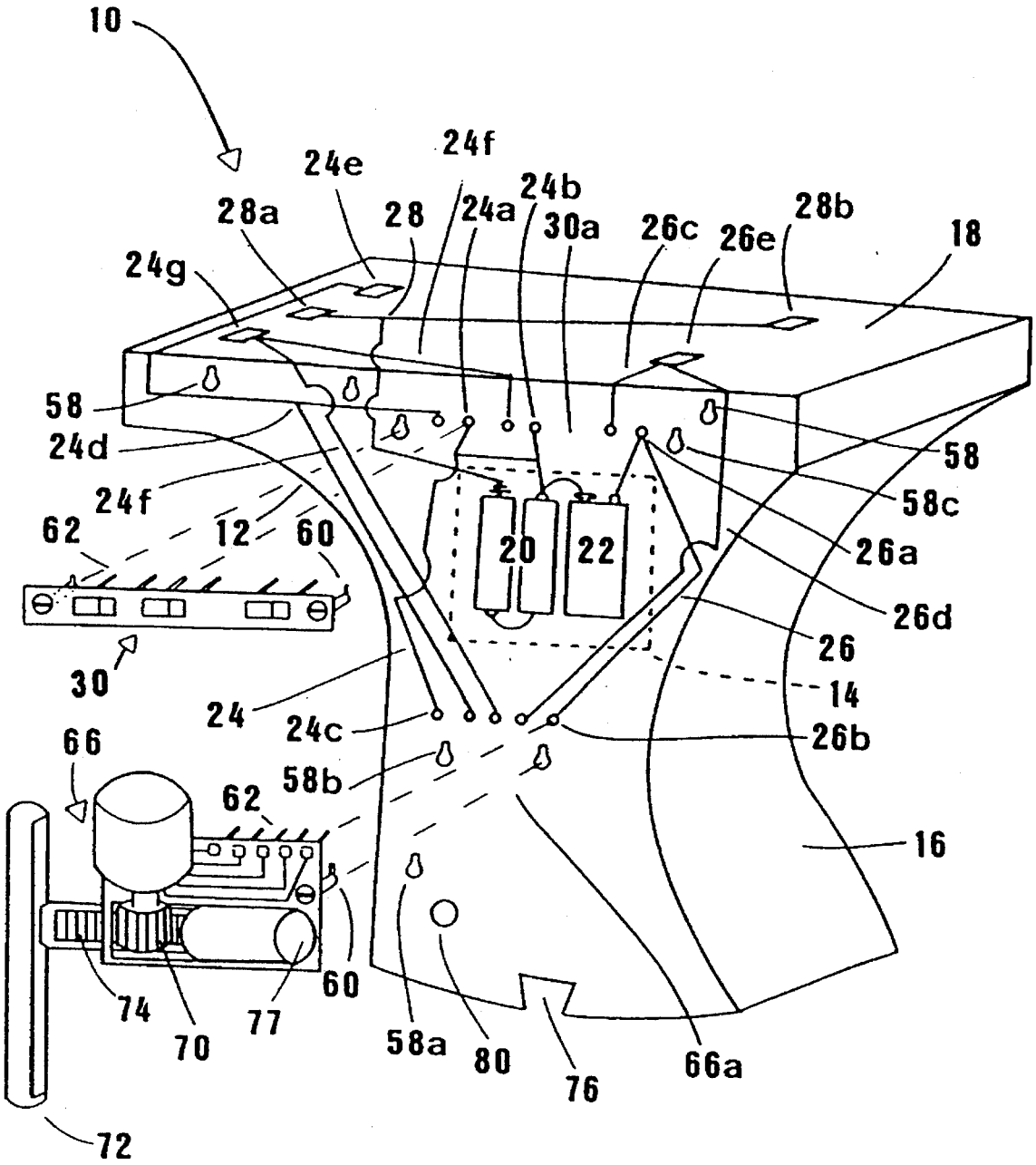
FIG. 1 is an exploded perspective view of switch modules and a body for a modular personal security device constructed in accordance with the teachings of the present invention with conductive circuits superimposed thereon.

The preferred embodiment, a modular personal security device generally identified by reference numeral 10, will now be described with reference to FIGS. 1 through 14.

Figure 12:
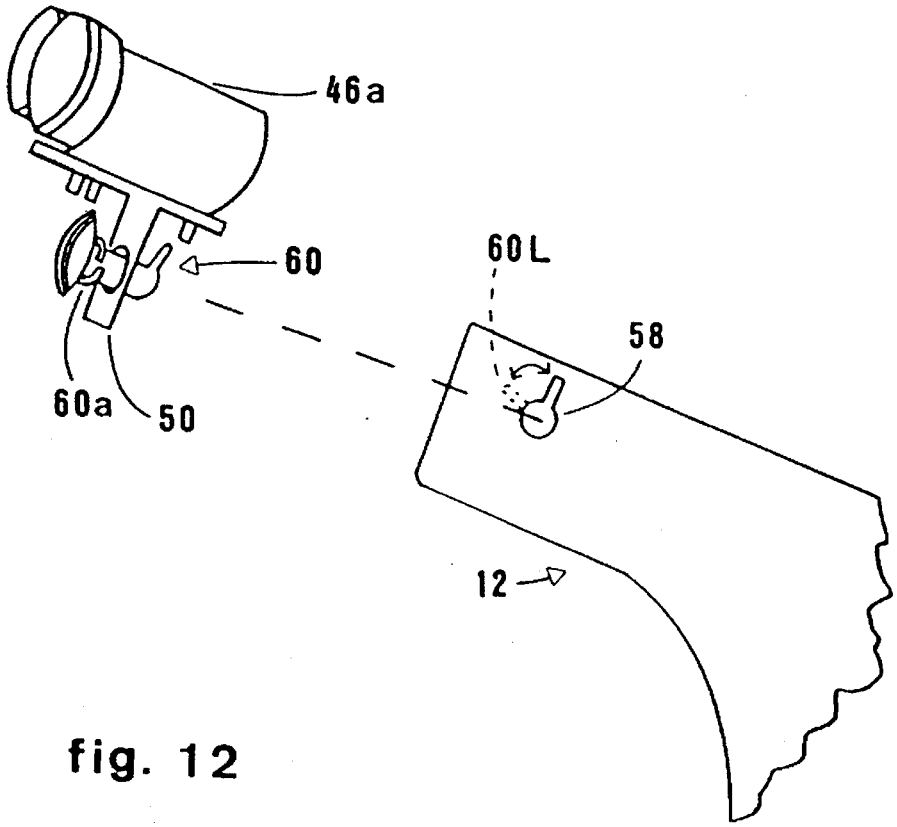
FIG. 12 is an exploded detailed view of a locking mechanism.

Referring to FIG. 1, the modular personal security device 10 includes a body 12 having an interior battery receiving cavity 14, a handgrip 16 and a top mounting surface 18 for electronic and mechanical modules (not shown). Mounting points 66a and 30a are provided for electronic switch modules 66 and 30, respectively, on body 12. Battery receiving cavity 14 has a 3 volt power source consisting of two 1.5 volt 'AA' batteries 20 connected in series. There is also a 9 volt battery 22, which provides additional power for a high voltage power source as will be hereinafter further explained. Personal security device 10 operates with modular units which will hereinafter be more fully described; not all of which require the same power. Batteries 20 constitutes a low voltage power source. The voltage of 1.5 volt batteries 20 combined in series with 9 volt battery 22 provide a high voltage power source of 12 volts. A first power supply circuit 24 extends from the low voltage power source represented by batteries 20 within battery receiving cavity 14 to female switch connectors 24*a*, 24*b* and 24*c*. Slide switch bank module 30 and rotary trigger switch module 66 have male conductive connectors 62 which mate with female connectors 24*a*, 24*b*, and 24*c*. Some of male conductive connectors 62 extend to power lines 24*f* and 24*d* to supply power lines 24*f* and 24*d* when the switches are activated. Referring to FIGS. 1 and 12, the switch members have rotatably mounted depending key-like fasteners 60, that insert into axially aligned key hole receptacles 58*b* to attach rotary trigger switch module 66 onto body 12 at mounting point 66*a* and key hole receptacles 58*c* to attach slide switch bank module 30 onto body 12 at mounting point 30*a*. The operation of switch modules 66 or 30 can complete first power supply circuit 24. First power supply circuit 24 includes a power line 24*f* extending to female power connector 24*g* located on mounting surface 18 and a power line 24*d* extending to a female power connector 24*e* also located on mounting surface 18. Female power connector 24*g* is intended to receive a low beam light and female power connector 24*e* is intended to receive a high beam light as will hereinafter be further described. Second power supply circuit 26 extends from the high voltage power source represented by the combined power of batteries 20 and 22 within battery receiving cavity 14 to female connectors 26*a* and 26*b*. As previously described, slide switch bank 30 and rotary trigger switch 66 have male conductive connectors 62 that are insertable into female connectors 26*a* and 26*b* to supply power into switch modules with some of male conductive connectors 62 used to extend power to lines 26*c* and 26*d* when switches are activated. The operation of switch modules 66 or 30 can complete second power supply circuit 26. Second power supply circuit 26 includes power lines 26*c* and 26*d* to female power connector 26*e* located on top mounting surface 18. Female power connector 26*e* is mated with modular units requiring high voltage. Both high and low voltage circuits share a common ground source extending from low voltage battery 20, along ground line 28 to female ground connector 28*b* for high voltage circuit, and female ground connector 28*a* for the low voltage circuit. Referring to FIG. 12 all modules have a rotatably mounted depending key-like fastener 60 that inserts into key hole receptacles 58 located on body 12 or on companion modules designed for stacking. Once inserted key-like fastener 60 is rotated ¼ turn with a screwdriver or the like to move a projection 60L on key-like fastener 60 out of register with key hole receptacle 58 to place key-like fastener 60 in a locked position. Compression or lock washer 60*a* maintains key-like fastener 60 in the locked position.

Figure 2:
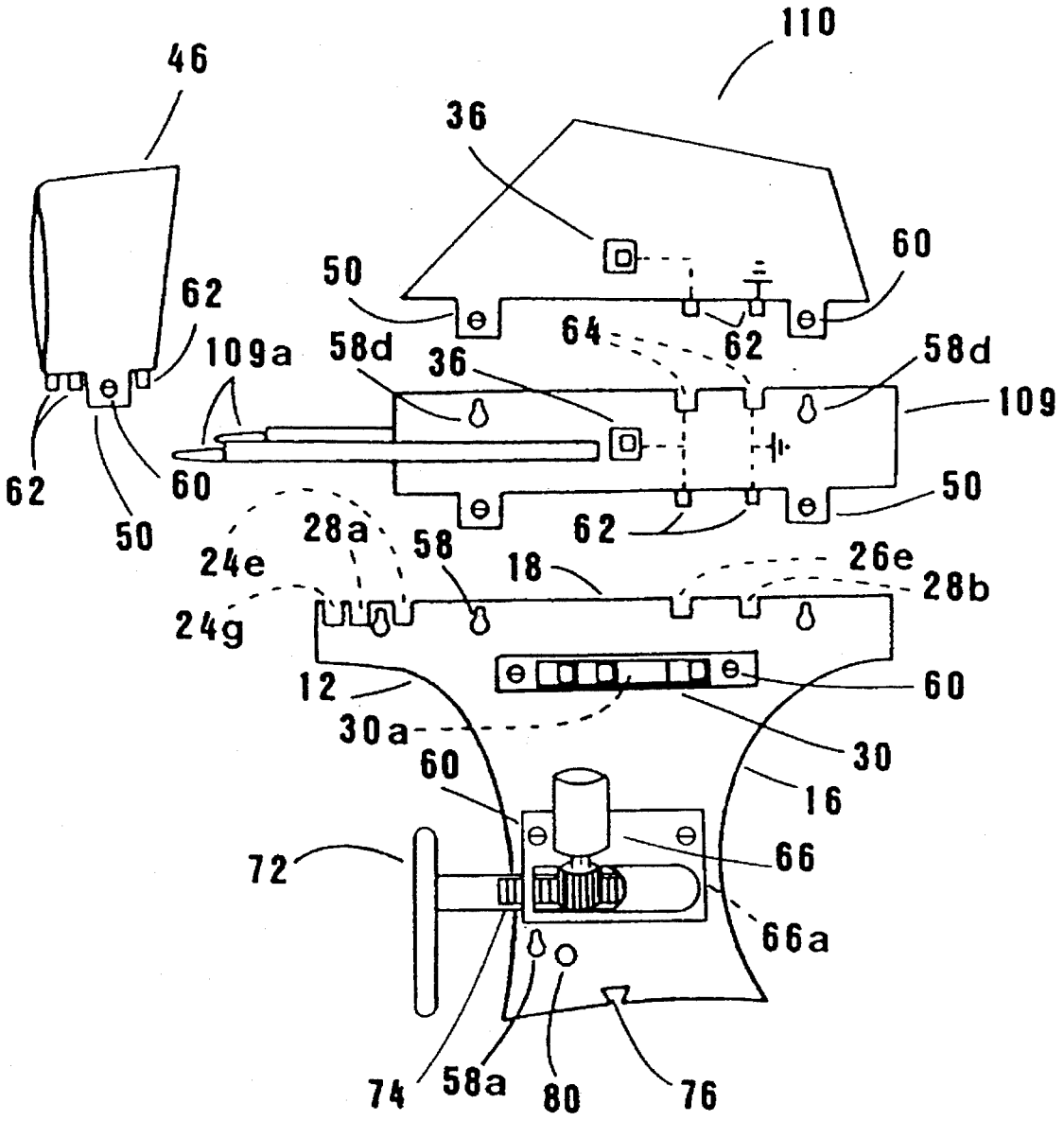
FIG. 2 is an exploded side elevation view of modular electronic units and the body illustrated in FIG. 1 with switch modules attached.
Figure 3:
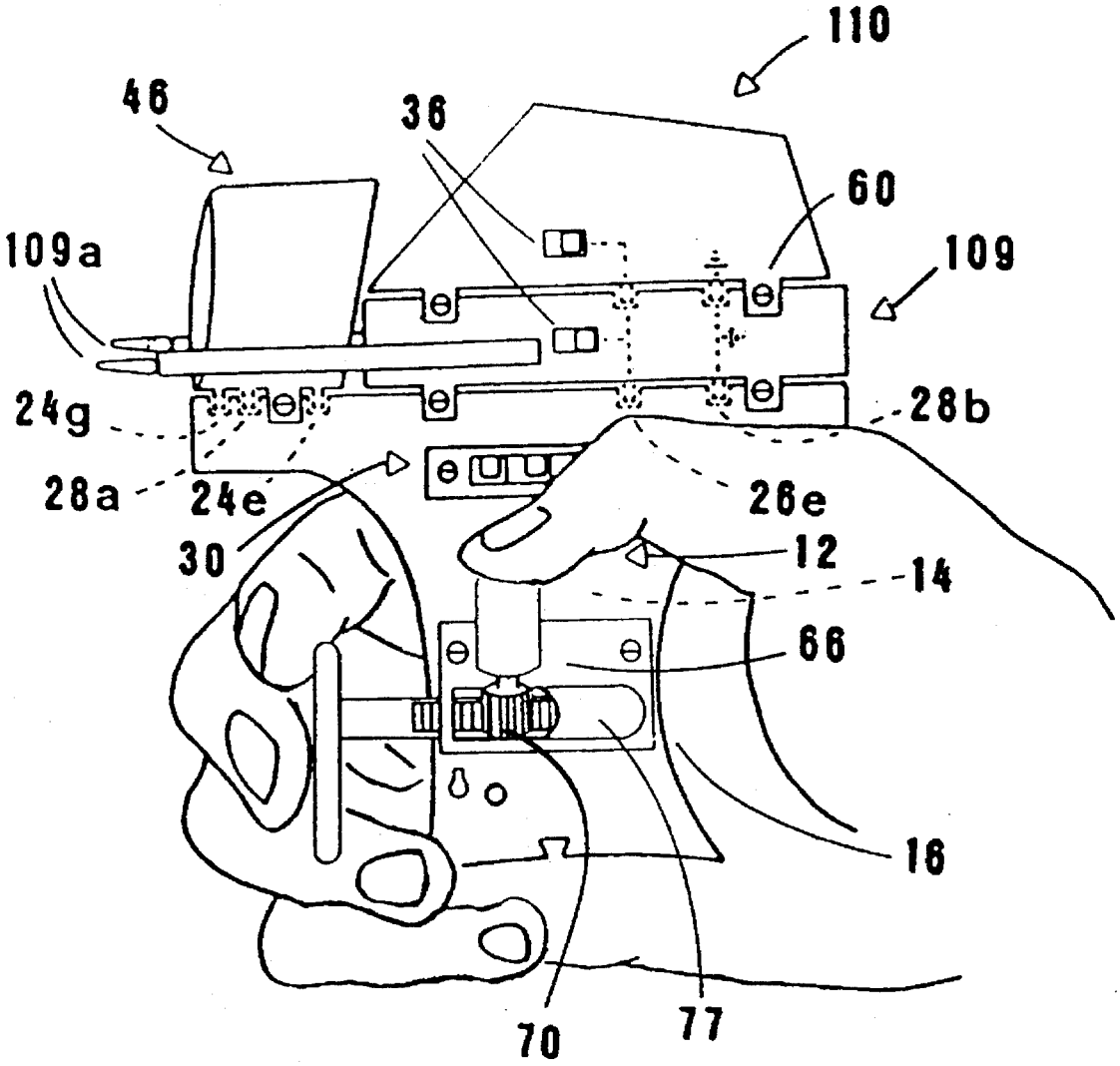
FIG. 3 is a side elevation view of a fully assembled modular security device illustrated in FIG. 2.

Referring to FIG. 2 and 3, there is illustrated body 12 with slide switch bank module 30, rotary trigger switch module 66, a low voltage high-beam/low beam light module 46 with a plurality of high voltage modular electronic units; high voltage stun module 109, and pain field generator 110. Electronic modules 109, 46 and 110 all have depending male members 50 that play a role in permitting the modules to interlock with body 12 or with other modules in a stacked fashion. Male members 50 each have rotatably mounted depending key-like fasteners 60. Male members 50 are positioned to overlap until key-like fasteners 60 are axially aligned with key holes 58 on body 12 (or 58*d* on module 109). Key-like fasteners 60 are then inserted into key holes 58 or 58*d* and rotated ¼ turn to lock them together. In FIGS. 2 and 3, light module 46 and high voltage stun module 109 are secured in this fashion to body 12, and pain field generator 110 is secured in this fashion to high voltage stun module 109. Modular electronic units 109, 46 and 110 also have depending male conductive connectors 62. When modular electronic unit 46 is positioned on top mounting surface 18, male conductive connectors 62 mate with first power connectors 24*g*, 24*e* and ground connect 28*a*. When module 109 is positioned on top mounting surface 18, the modules male conductive connectors 62 mate with second power connector 26*e* and ground connect 28*b*. High voltage stun module 109 also has female conductive connectors 64. Female conductive connectors 64 mate with male conductive connectors 62 of pain field generator 110 to enable high voltage stun module 109 to serve as a conduit for electrical conduction from second power connector 26*e* and ground connect 28*b* on top mounting surface 18 to energize pain field generator 110.

Figure 7:
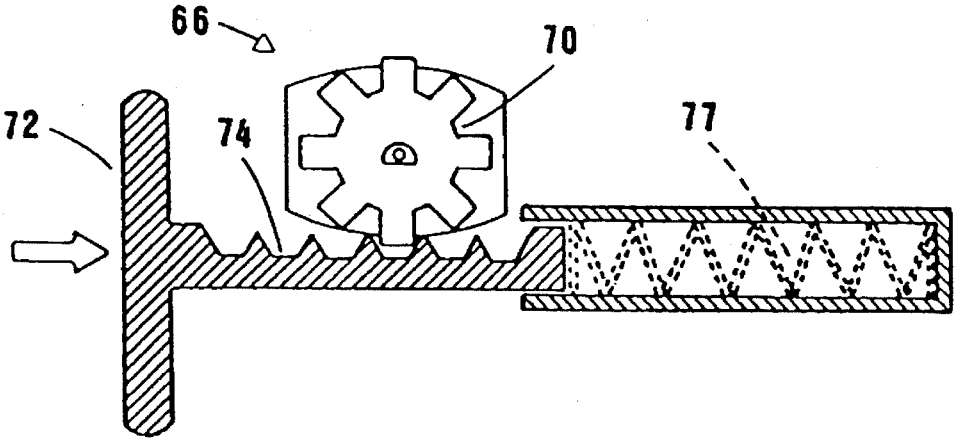
FIG. 7 is a detailed side elevation view of a trigger mechanism illustrated in FIG. 1.
Figure 8:
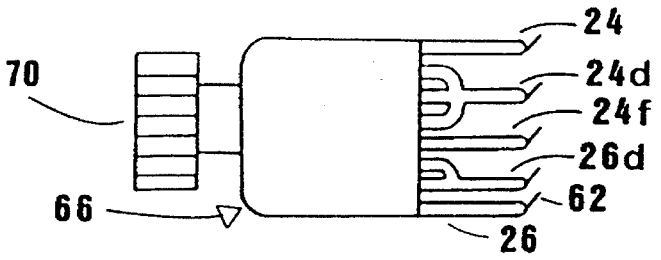
FIG. 8 is a detailed side elevation view of a rotary switch illustrated in FIG. 7.
Figure 9:
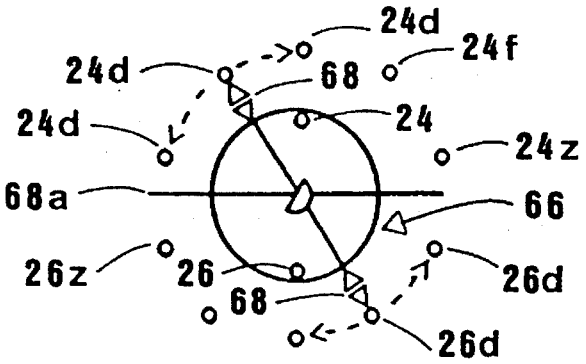
FIG. 9 is a section view of the rotary switch illustrated in FIG. 8.

Referring to FIGS. 2 and 3, positioned on body 12 is a slide switch bank module 30 to allow continuous operation of selected electronic modules independently from multi-position rotary trigger switch 66. Rotary trigger switch 66 allows a momentary operation of the electronic modules. Referring to FIG. 9, rotary switch 66 has a rotatable contact member 68. Referring to FIGS. 7 and 8, contact member 68 is non-rotatably coupled with pinion gear 70. Referring to FIG. 7 and 9, upon trigger 72 being manually pressed, the engagement between rack 74 and pinion gear 70 moves rotatable contact member 68 of rotary switch 66 in a counterclockwise direction to a first position, connecting first power supply circuit 24 with low beam light power line 24*f*. Upon trigger 72 being further pressed, the rotatable contact member 68 of rotary switch 66 assumes a second position connecting first power supply circuit 24 with high beam light power line 24*d*. With continued trigger travel, the third and fourth rotary switch positions utilize the two pole capability of rotary switch 66, by activating the low voltage, high beam lights power line 24*d*, in parallel with the high voltage modules power line 26*d* simultaneously, with contact member 68 shown in this third rotary switch position in FIG. 9. Trigger 72 is blocked on fourth switch position, in order to prevent rotatable contact member 68 to continue into an unwanted position. When finger pressure is released from trigger 72, compression spring 77 returns trigger 72 causing rotatable contact member 68 to move in a clockwise direction to a "rest" or "off" fifth rotary switch position, where trigger 72 is blocked, to prevent compression spring 77 from extending rotatable contact member 68 past "rest" position into an activated switch position. Referring to FIG. 9 the diagram illustrates rotatable contact member 68 in a third rotary switch position activating low voltage power to high beam lights power line 24*d* in parallel with high voltage power extended to high voltage modules power line 26*d* simultaneously, 68*a* represents a nonconductive member interposed between the first and second power circuits, with low voltage power supply circuit 24 extending power via rotatable contact member 68 to low voltage contacts (24*d*, 24*f*) above line in diagram depicting nonconductive member 68*a* in parallel simultaneously with high voltage power supply circuit 26 extending high voltage power via rotatable contact member 68 to high voltage contacts (26*d*) below line in diagram depicting nonconductive member 68*a*. 24*z* and 26*z* represent the "rest" or "off" fifth rotary switch position rotatable contact member 68 rests in when not activated by trigger 72. Power lines from supply circuits 24 and 26 are not connected to contacts 24*z* and 26*z* in the fifth rotary switch position produces an off position.

The module configuration illustrated in FIGS. 2 and 3, gives the capability to activate this module combination in sequence by rotary trigger switch 66. By pressing trigger 72 to a first switch position, low beam portion of light module 46 is activated. Pressing trigger to a second switch position deactivates the low beam portion of light module 46 and turns on the high beam portion. Third and fourth rotary switch positions activate high beam light 46, stun module 109 and pain field generator 110 in unison, with high beam light 46 being able to illuminate a potential adversary, and pain field generator 110 designed to produce a high frequency sound oscillation that when directed towards an assailant can cause disorientation, ear discomfort, etc., as well as draw attention to potential assistance due to its siren effect. If the effects of pain field generator 110 do not deter a physical confrontation with the assailant, the activated stun module 109 can be used to neutralize attack by making physical contact with assailant with stun modules high voltage electrode 109*a* inflicting a low amperage, nonlethal electrical shock. Pressing trigger 72 at a fast rate into third or fourth switch positions, all modules will instantly activate simultaneously. Slide switches 36 and 30 can be operated independently or in unison with rotary trigger switch 66 to produce different combinations of module activations.

Figure 5:
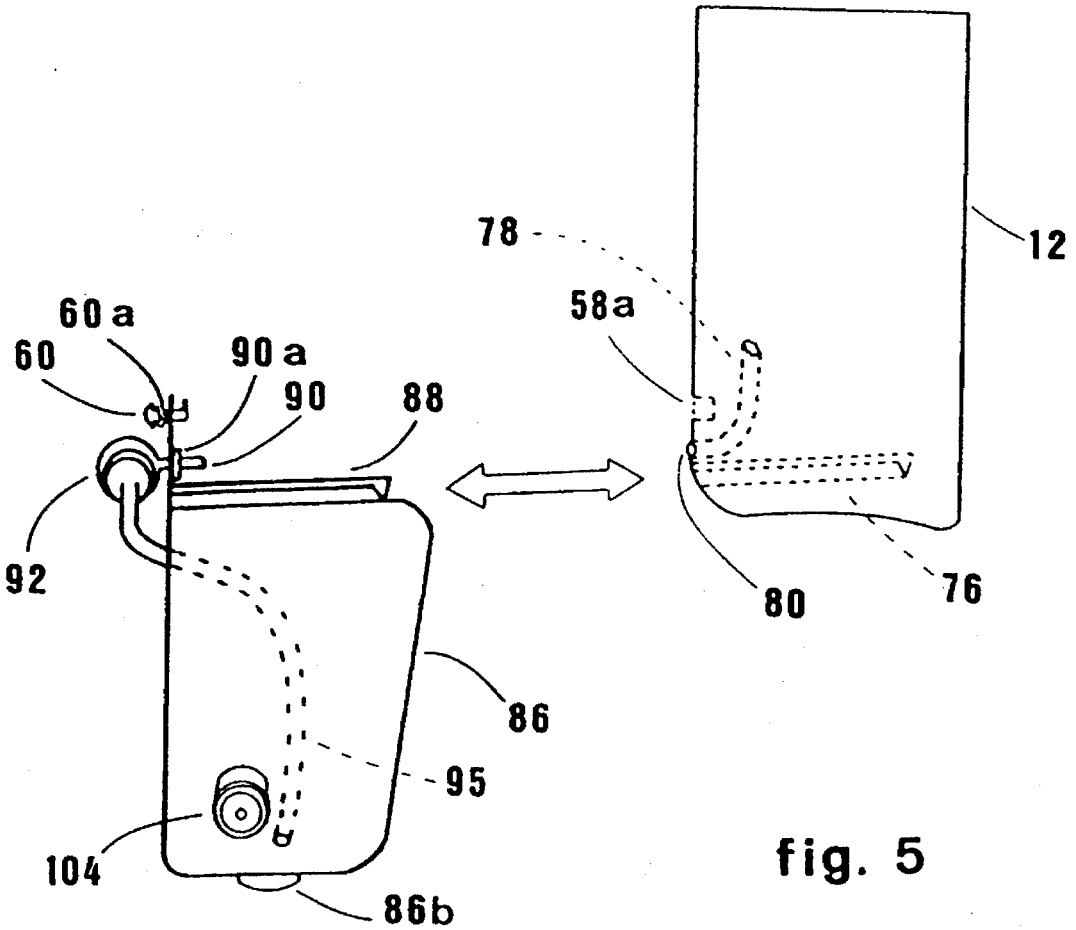
FIG. 5 is an exploded end elevation view of the body illustrated in FIG. 1 and the spray tank module illustrated in FIG. 4.
Figure 6:
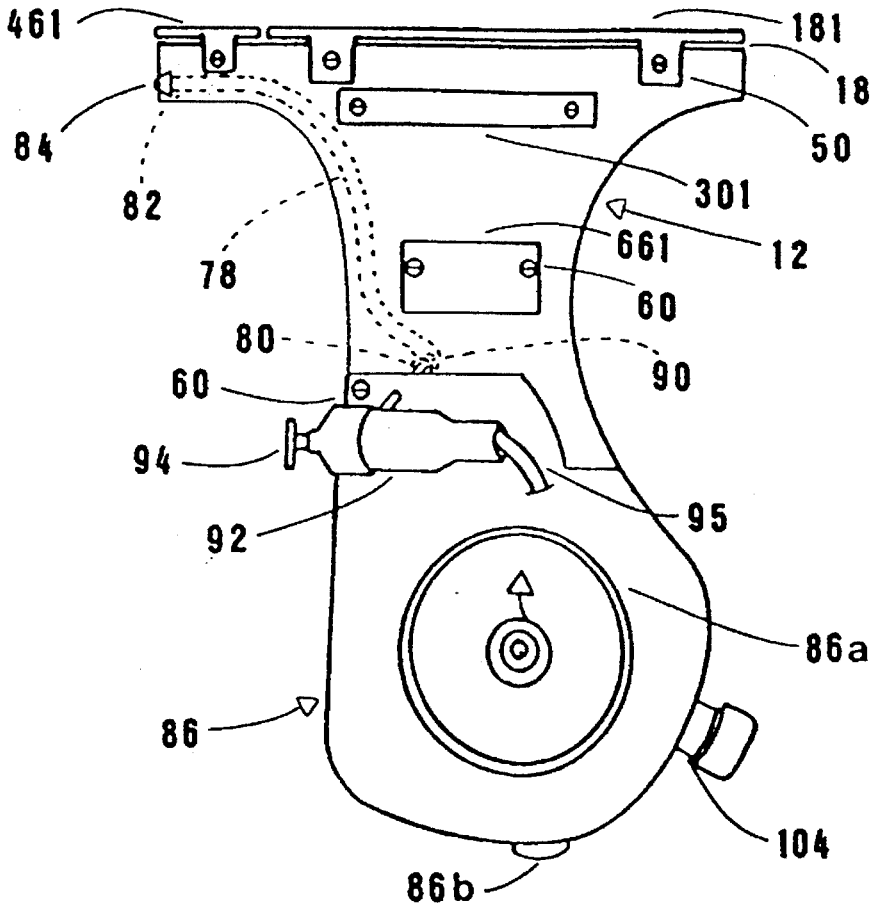
FIG. 6 is a side elevation view of the body illustrated in FIG. 1 interconnected with the spray tank module illustrated in FIG. 4.
Figure 10:
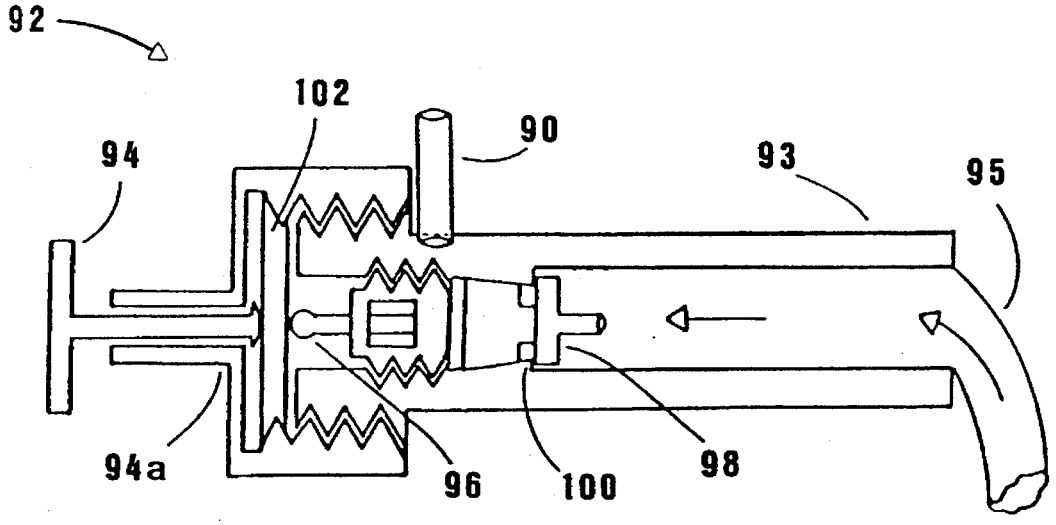
FIG. 10 is a side elevation view in longitudinal section of a actuating valve illustrated in FIG. 4.
Figure 11:
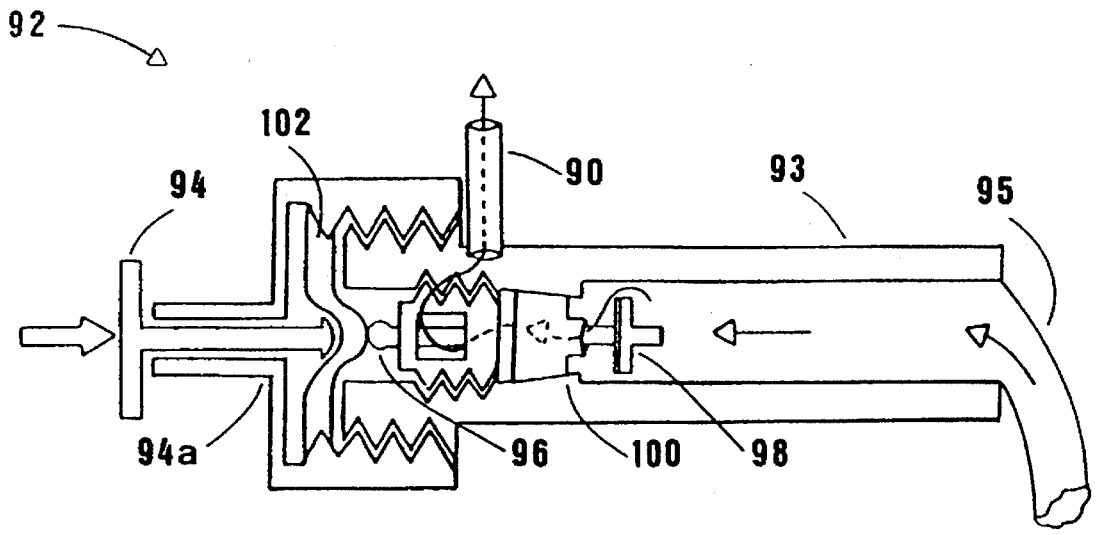
FIG. 11 is a side elevation view in longitudinal section of a actuating valve illustrated in FIG. 4.
Figure 14:
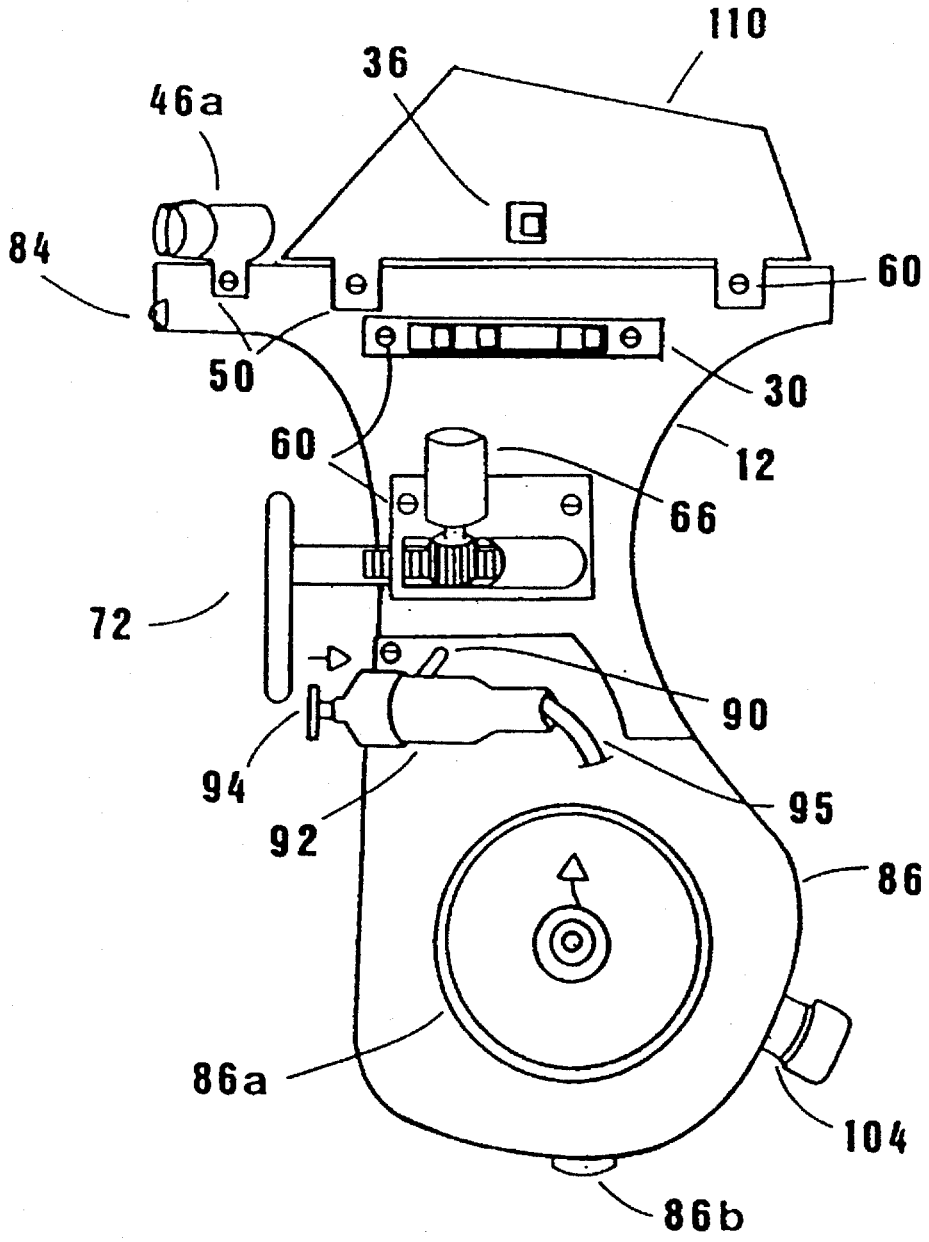
FIG. 14 is an assembled side elevation view of the personal security device illustrated in FIG. 13.

Referring to FIG. 1, body 12 has a spray tank mount in the form of a dovetail groove 76 on handgrip 16. Referring to FIG. 6, a liquid conduit 78 extends through body 12. Liquid conduit 78 has a connector end 80 positioned adjacent dovetail groove 76 and an opposed end 82 with a forwardly directed nozzle 84. Referring to FIG. 5, a spray tank 86 having a dovetail tongue 88 mates with dovetail groove 76 to connect spray tank 86 to body 12. Spray tank 86 has a male outlet adaptor 90 insertable into connector end 80 of liquid conduit 78. Male adaptor 90 has rubber seal 90*a* attached to prevent leakage at connection point with connector end 80. Spray tank 86 has a rotatably mounted key-like fastener 60, that is then inserted into receptacle 58*a* located adjacent connector end 80 and rotated ¼ turn to lock spray tank 86 to body 12. Spray tank 86 has an actuating valve 92. FIGS. 10 and 11, provide detailed views of actuating valve 92; an improvement over a standard air valve which produces a push button fluid control and includes a dip tube inlet 95, a male outlet adaptor 90, a plunger member 94, a valve cap 94*a*, and a sealing membrane 102. Actuating valve 92 consists of a cylindrical barrel 93 with fluid communication through dip tube inlet 95 and male outlet adaptor 90. A valve member 98 rests against a valve seat 100 in between dip tube inlet 95 and male outlet adaptor 90 to control the flow of fluids from dip tube inlet 95 to male outlet adaptor 90. Valve member 98 is attached to a moveable member 96. Referring to FIG. 11, a plunger member 94 acts upon movable member 96 to move valve member 98 away from valve seat 100 to selectively allow a flow of fluids. Plunger member 94 is positioned in a bored-out stemmed valve cap 94*a*. A flexible sealing membrane 102 is interposed between plunger member 94 and moveable member 96. Referring to FIG. 14, actuating valve 92 is on a common plane with trigger 72. Trigger 72 engages plunger member 94 of actuating valve 92 when trigger 72 is fully depressed to the end of travel.

Figure 4:
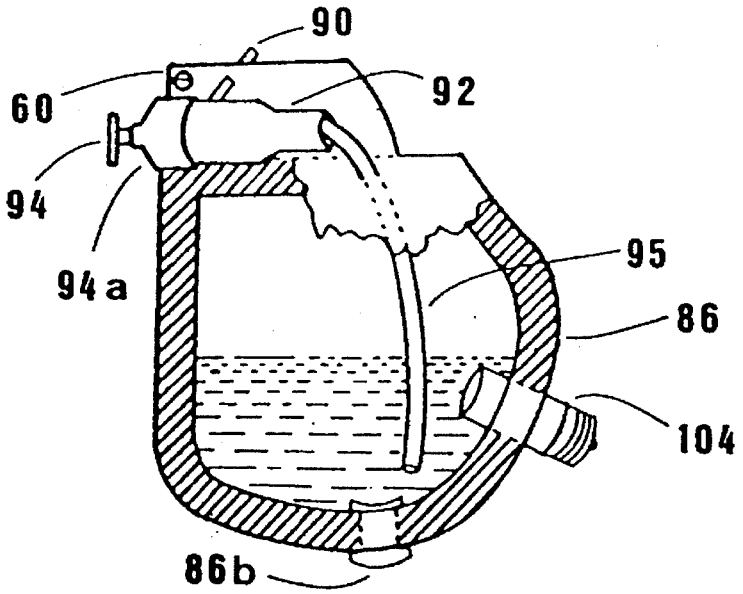
FIG. 4 is a partially cut away side elevation view of a spray tank module.

Referring to FIG. 4 and 6, spray tank 86 has an air valve 104 that enables spray tank 86 to be pressurized by means of an air pump (not shown), with pressure monitored by gauge 86*a*, and pressure relief valve 86*b*. Air valve 104 can also be used to recharge tank reservoir by injecting liquid through air valve 104 with a syringe type device, equipped with an air valve adaptor. There are a variety of modular units than can be employed. FIG. 2 and 3 show a high and low beam light module 46 with a combined high voltage stun module 109 and pain field generator 110. As described in relation to modular electronics 109, 46, and 110, all modular units have depending male conductive connectors 62 and depending male members 50 with rotatably mounted depending key-like fasteners 60. Referring to FIGS. 2 and 3, some modules, such as modules 109, are intended to have other modules stacked on top of them and therefore have key-hole receptacles 58*d* and female conductive connectors 64.

FIG. 6 illustrates weather-resistant plate 181 on top mounting surface 18 if high voltage modules are deleted. Plates 301, 661 and 461 are used if switch and light modules are not required, for example if only the spray system was desired, which could be discharged by finger pressure. If stacking modules with top female electrical connectors 64 are used, plate 181 can be attached on top of the last module in the stack to insure electronic circuits are shielded from the weather.

Figure 13:
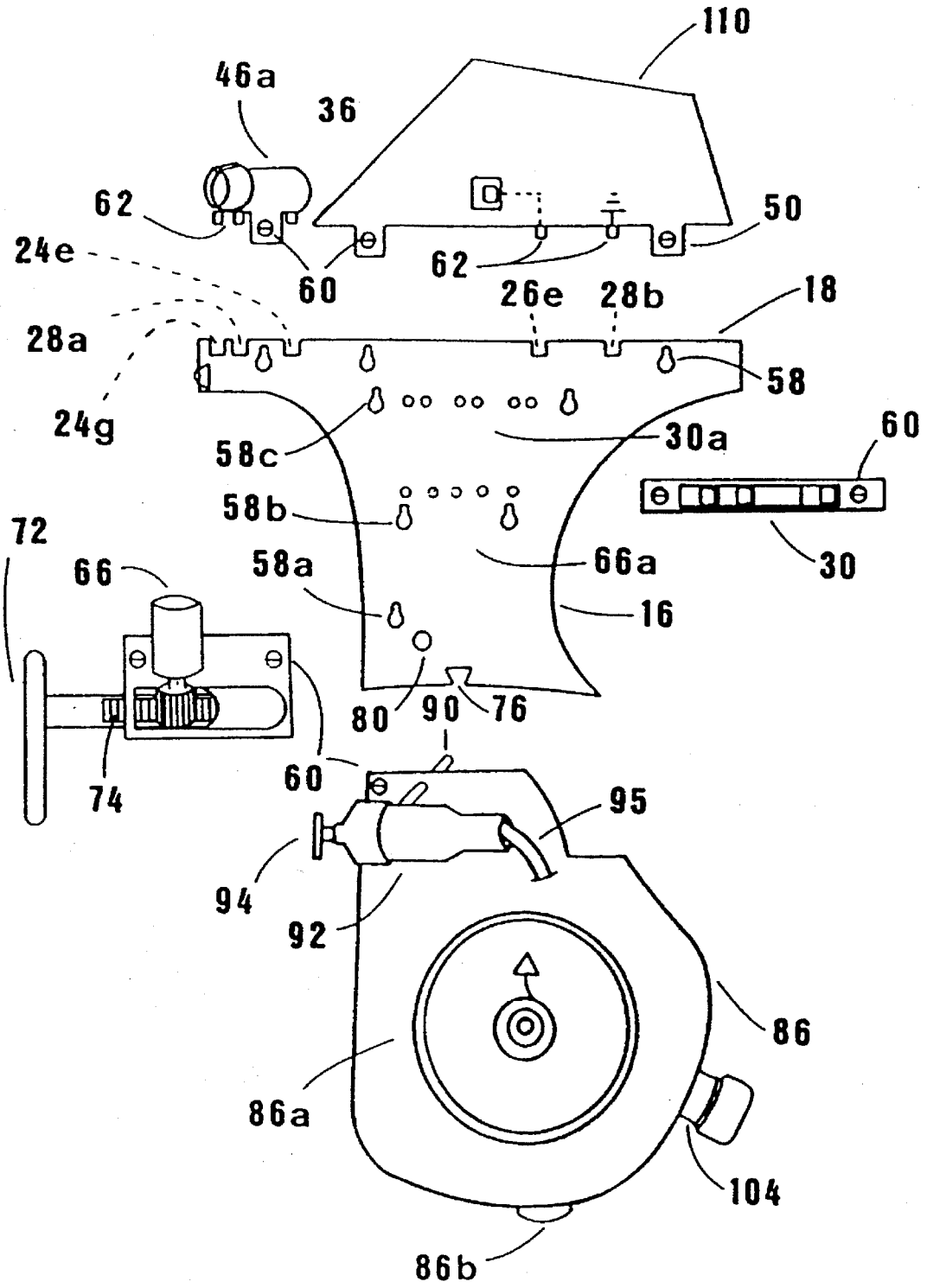
FIG. 13 is an exploded side elevation view of a personal security device constructed in accordance with the teachings of the present invention.

Referring to FIGS. 13 and 14, there is illustrated a version of personal security device 10 with modules that can be activated in sequence or simultaneously. The modules provided include high beam/low beam light 46*a* (smaller version of module 46) pain field generator 110, rotary trigger switch 66, slide switch bank 30 and spray tank 86.

The use and operation of modular personal security device 10 will now be described with reference to FIGS. 1 through 14. In order to prepare the version of personal security device 10 illustrated in FIG. 14 for use, spray tank 86 is attached to body 12 by mating dovetail tongue 88 with dovetail groove 76 and inserting male outlet adaptor 90 into connector end 80 of liquid conduit 78, as illustrated in FIGS. 5 and 6. Spray tank module 86 has a rotatably mounted key-like fastener 60. Key-like fastener 60 is axially aligned with and then inserted into key hole receptacle 58*a* on body 12. By rotating key-like fastener 60 ¼ turn spray tank module 86 is locked to body 12 with male outlet adaptor 90 projecting into connector end 80 of liquid conduit 78. Referring to FIGS. 13 and 14, painfield generator module 110 is then attached to top mounting surface 18 of body 12 by overlapping male members 50 of module 110 and inserting key-like fasteners 60 into key hole receptacles 58 on body 12. By rotating key-like fasteners 60 pain field generator module 110 is locked to body 12. Male conductive connectors 62 on pain field generator module 110 mate with high voltage female power connector 26*e* and female ground connect 28*b*. Light module 46*a* is attached to top mounting surface 18 in a similar fashion where male connectors 62 mate with low voltage female power connectors 24*g*, 24*e* and ground connect 28*a*. Rotary switch module 66 is similarly attached by mating key-like fasteners 60 with key hole receptacles 58*b* on body 12 at mounting point 66*a*. Slide switch module 30 also attaches in a similar fashion by mating key-like fasteners 60 with key hole receptacles 58*c* on body 12 at mounting point 30*a*. When switch modules 30 and 66 are attached male conductive connectors 62 on the switch modules mate with female switch connectors at mounting points 30*a* and 66*a*, respectively, to connect with the switch circuits illustrated in FIG. 1. Once this module combination is attached to body 12, the sequence of activation would be in accordance with the following description. The person pulls trigger 72 at a moderate speed on rotary switch 66 to the first power switch position in order to place light 46*a* on low beam, for example low beam light may be used to shine light upon a car door, house door or the like to enable safe entry with key. The person pulls trigger 72 to the second rotary switch position which deactivates low beam light and turns on high beam light portion of 46*a* if a more intense light is needed. If the operator feels threatened in any way, by pressing trigger to third rotary switch position, high beam light 46*a* and pain field generator 110 are activated in unison with the pain field generator being an alarm designed to produce a high frequency sound oscillation that when directed towards an assailant, disorientation, ear discomfort, etc. can develop within the assailant, as well as drawing attention to potential assistance within the area due to the siren sound effect of module 110. If a hitch-pin (not shown) is used to restrain plunger member 94 on actuating valve 92 located on spray tank 86, trigger 72 becomes restrained against hitch-pin, allowing for a continuous third rotary switch positions activation of high beam light and pain field generator, and also prevents premature or accidental spray discharges. If threat situation increases, the hitch pin can be removed to allow trigger 72 to be pressed to the end of travel activating fourth rotary switch position of pain field generator 110, high beam light 46*a*, simultaneously with plunger member 94 of actuating valve 92 being depressed to direct a disabling spray from spray tank 86 out of nozzle 84 at the attacker, with high beam light 46*a* having the capability to illuminate intended target for the spray direction if needed, in parallel with the activated pain field generators high frequency sound oscillation effects on assailant as well as potential to draw attention for possible assistance from the siren sound effect of module 110. By pressing rotary trigger 72 at a fast rate, all modules can be activated simultaneously.

It will be apparent to one skilled in the art that modifications may be made to the illustrated embodiments without departing from the spirit and scope of the invention as defined in the following claims.

The embodiments of the invention in which an exclusive property or privilege is claimed are defined as follows:

1. A modular personal security device, comprising:

a. a body having an interior battery receiving cavity, a handgrip, at least one module mounting surface whereby electronic and mechanical personal security modular units are mounted to the body, a first power supply circuit connecting the battery receiving cavity with a first power switch connector on the body and a first power connector on the module mounting surface, a second power supply circuit connecting the battery receiving cavity with a second power switch connector on the body and a second power connector on the module mounting surface, the first power supply circuit and the second power supply circuit each having at least one ground line extending from the battery receiving cavity to a respective first ground connector and a respective second ground connector on the module mounting surface;

b. a multi-position trigger activated switch module connected to the first power switch connector and the second power switch connector, such that upon the trigger being manually pressed in a first direction to a first position the first power switch connector completes the first power supply circuit thereby supplying power to a personal security modular unit mated with the first power connector, and upon the trigger being further linearly in said first direction to another position the first power switch connector completes the first power supply circuit and the second power switch connector completes the second power supply circuit thereby simultaneously supplying power to said personal security modular unit mated with the first power connector and a personal security modular unit mated with the second power connector.

2. The modular personal security device as defined in claim 1, wherein the body has a spray tank mount and a liquid conduit extending through the body, the liquid conduit having a connector end positioned adjacent the spray tank mount and an opposed end with a forwardly directed nozzle, and a spray tank secured to the spray tank mount, the spray tank having a male adaptor insertable into the connector end of the liquid conduit and an actuating valve, such that upon the actuating valve being depressed liquid from the spray tank is released under pressure through the connector end of the liquid conduit to the forwardly directed nozzle.

3. The modular personal security device as defined in claim 2, wherein the spray tank mount includes a dovetail groove on the handgrip adapted to mate with a dovetail tongue on the spray tank.

4. The modular personal security device as defined in claim 1, wherein the multi-position switch is a multi-position 2-pole rotary switch with at least five positions including an initial "off" position, having a rotatable contact member non-rotatably coupled with a pinion gear, and the trigger has a rack which engages the pinion gear such that upon the trigger being manually pressed the rotatable contact member is rotated from the initial "off" position to the first position and upon trigger being further pressed the rotatable contact member is rotated to the second position, and upon the trigger being further pressed the rotatable contact member is rotated to the third position, biasing means acting upon the trigger such that the trigger is returned to an "off" position upon the pressure on the trigger being released.

5. The modular personal security device in claim 1, wherein the first power supply circuit provides a low voltage power source and the second power supply circuit provides a high voltage power source.

6. The modular personal security device as defined in claim 1, wherein said modular units are provided having rotatably mounted depending key-like fasteners and wherein the body includes axially aligned key hole receptacles, the key-like fasteners being insertable into the key hole receptacles such that upon partial rotation of the key-like fastener the key-like fastener is locked in a mated position within the key hole receptacle.

7. The modular personal security device as defined in claim 1, wherein the first power supply circuit and the second power supply circuit have secondary switch connectors connected to a slide switch bank module thereby providing a secondary means for activating selected modular units mated with the first power connector and the second power connector.

8. The modular personal security device as defined in claim 1, wherein the modular units have bottom surfaces with depending male conductive connectors and top surfaces with female conductive connectors, the modular units being adapted for stacking with the male conductive connectors of one modular unit mating with the female conductive connectors of another modular unit such that the mating of the male conductive connectors with the female conductive connectors serves as an electrical conduit to transfer power from one of the power supply circuits on the body to a plurality of stacked modular units.

9. A modular personal security device, comprising:

a. a body having an interior battery receiving cavity, a handgrip, at least one module mounting surface whereby electronic and mechanical personal security modular units are mounted to the body, a first power supply circuit connecting the battery receiving cavity with a first power switch connector on the body and a first power connector on the module mounting surface, a second power supply circuit connecting the battery receiving cavity with a second power switch connector on the body, a second power connector on the module mounting surface, the first power supply circuit and the second power supply circuit each having at least one ground line extending from the battery receiving cavity to a respective first ground connector and a respective second ground connector on the module mounting surface;

b. a multi-position trigger activated 2-pole rotary switch module connected to the first power switch connector and the second power switch connector, the switch module having at least five positions including an initial "of" position, a rotatable contact member being non-rotatably coupled with a pinion gear, and the trigger having a rack which engages the pinion gear such that upon the trigger being manually pressed the rotatable contact member is rotated in a counterclockwise direction from the initial "off" position to a first position in which the first power switch connector completes the first power supply circuit thereby supplying power to a personal security modular unit mated with the first power connector, and upon the trigger being further pressed to a second position the second power switch connector completes the second power supply circuit thereby supplying power to a personal security modular unit mated with the second power connector, and upon the trigger being further pressed to a third position the first power switch connector completes the first power supply circuit and the second power switch connector completes the second power supply circuit thereby simultaneously supplying power to said personal security modular unit mated with the first power connector and said personal security modular unit mated with the second power connector;

c. a spray tank mount on the body and a liquid conduit extending through the body, the liquid conduit having a connector end positioned adjacent the spray tank mount and an opposed end with a forwardly directed nozzle; and d. a spray tank secured to the spray tank mount, the spray tank having a male adaptor insertable into the connector end of the liquid conduit and an actuating valve which is on a common plane with the trigger, such that the trigger engages the actuating valve as the trigger is depressed to the end of travel corresponding to a fourth switch position, thereby resulting in a simultaneous activation of modular units connected to first power supply circuit, activation of modular units connected to second power supply circuit and the discharge of spray medium through the forward directed nozzle.

10. The modular personal security device as defined in claim 9, wherein the spray tank mount includes a dovetail groove on the handgrip adapted to mate with a dovetail tongue on the spray tank.

11. The modular personal security device as defined in claim 9, wherein the spray tank has an air valve whereby the spray tank is pressurized with an air pump.

12. In combination:

a. a modular personal security device, comprising:

i. a body having an interior battery receiving cavity, a handgrip, at least one module mounting surface whereby electronic and mechanical personal security modular units are mounted to the body, a first power supply circuit connecting the battery receiving cavity with a first power switch connector on the body and a first power connector on the module mounting surface, a second power supply circuit connecting the battery receiving cavity with a second power switch connector on the body and a second power connector on the module mounting surface, the first power supply circuit and the second power supply circuit each having at least one ground line extending from the battery receiving cavity to a respective first ground connector and a respective second ground connector on the module mounting surface;

ii. a multi-position trigger activated 2-pole rotary switch module connected to the first power switch connector and the second power switch connector, the switch module having at least five positions including an initial "off" position, a rotatable contact member being non-rotatably coupled with a pinion gear, and the trigger having a rack which engages the pinion gear such that upon the trigger being manually pressed the rotatable contact member is rotated in a counterclockwise direction from the initial "off" position to a first position in which the first power switch connector completes the first power supply circuit thereby supplying power to a personal security modular unit mated with the first power connector, and upon the trigger being further pressed to a second position the second power switch connector completes the second power supply circuit thereby supplying power to a personal security modular unit mated with the second power connector, and upon the trigger being further pressed to a third position the first power switch connector completes the first power supply circuit and the second power switch connector completes the second power supply circuit thereby simultaneously supplying power to said personal security modular unit mated with the first power connector and said personal security modular unit mated with the second power connector; and b. said personal security modular units having bottom surfaces with depending male conductive connectors and top surfaces with female conductive connectors, the modular units being adapted for stacking with the male conductive connectors of one modular unit mating with the female conductive connectors of another modular unit such that the mating of the male conductive connectors with the female conductive connectors serves as an electrical conduit to transfer power from one of the power supply circuits on the body to a plurality of stacked modular units.

* * * * *